US007903072B2

(12) United States Patent
Yamazaki

(10) Patent No.: US 7,903,072 B2
(45) Date of Patent: Mar. 8, 2011

(54) ELECTRO-OPTICAL DEVICE, DRIVING CIRCUIT, AND ELECTRONIC APPARATUS FOR DECREASING FRAME SIZE

(75) Inventor: Katsunori Yamazaki, Matsumoto (JP)

(73) Assignee: Epson Imaging Devices Corporation, Azumino-Shi (JP)

( * ) Notice: Subject to any disclaimer, the term of this patent is extended or adjusted under 35 U.S.C. 154(b) by 767 days.

(21) Appl. No.: 11/976,292

(22) Filed: Oct. 23, 2007

(65) Prior Publication Data

US 2008/0224982 A1 Sep. 18, 2008

(30) Foreign Application Priority Data

Mar. 14, 2007 (JP) ..... 2007-064503

(51) Int. Cl.
*G09G 3/36* (2006.01)

(52) U.S. Cl. ..... 345/98

(58) Field of Classification Search ..... 345/98–100
See application file for complete search history.

(56) References Cited

U.S. PATENT DOCUMENTS 7,151,520 B2 * 12/2006 Maki ..... 345/99
7,362,300 B2 * 4/2008 Hirama ..... 345/100

FOREIGN PATENT DOCUMENTS

| | | |
|---|---|---|
| GB | 2 325 329 A | 11/1998 |
| JP | A-61-223791 | 10/1986 |
| JP | A-06-138851 | 5/1994 |
| JP | A-10-319924 | 12/1998 |
| JP | A-11-112244 | 4/1999 |
| JP | A-2004-235793 | 8/2004 |

* cited by examiner

*Primary Examiner* — Chanh Nguyen
*Assistant Examiner* — Allison Walthall
(74) *Attorney, Agent, or Firm* — Oliff & Berridge, PLC

(57) ABSTRACT

The object of the present invention is to decrease a frame size in a case where data lines are driven by using a demultiplexer. The data lines 114 are divided into groups each having three data lines. TFTs 52 and 54 are provided for each data line 114, and the TFT 52 between the TFTs has a source electrode commonly connected in each group and a drain electrode connected to the data line 114. In addition, the TFT 54 has a source electrode connected to the data line 114 and a drain electrode commonly connected in each group. A data signal output circuit 32 that outputs data signals having voltage values in accordance with gray scale levels of sub-pixels corresponding to intersections of a selected scan line and a selected data line in each group to each group. Since the selected data line 114 is connected to an inverting input terminal of an operational amplifier 34 through the TFT 54, the operational amplifier 34 controls the voltage of the data line 114 to be identical to the voltage of a signal output from the data signal output circuit.

9 Claims, 9 Drawing Sheets

ELECTRO-OPTICAL DEVICE, DRIVING CIRCUIT, AND ELECTRONIC APPARATUS FOR DECREASING FRAME SIZE

BACKGROUND

1. Technical Field

The present invention relates to technology for driving data lines using a demultiplexer.

2. Related Art

Recently, in electronic devices such as cellular phones or navigation systems, technology for displaying high-definition images has been developed. The high-definition images can be achieved by increasing the number of scan lines and the number of data lines so as to increase the number of pixels, and in such a case, there is a problem in connections in the display panels. For example, when color display of vertical 320 dots×horizontal 240 dots is to be performed, total 720 data lines for 240 dots×3 colors are required in a horizontal direction of the display panel, but when the size of a display image is small, the pitches of the data lines become below the limit for COG (chip on glass) or the like, and accordingly, X drivers that supplies data signals to the data lines cannot be connected to the data lines.

Thus, a so-called hybrid method in which the 720 data lines, when the above-described display panel is used, are divided into groups, for example, each having three data lines, data signals for the three data lines belonging to each group are provided by using a time-division method, and a demultiplexer for sequentially selecting one data line from among the three data lines at a time and supplying data signals to the selected data line is formed integrally with pixel switching elements of the display panel has been proposed (for example, see JP-A-6-138851 (for example, FIG. 1)). By using this hybrid method, the number of input terminals of the demultiplexer decreases to ⅓ of the number of the data lines so as to loosen the connection pitches, and accordingly, it can be performed easily to mount the X drivers in the display panel.

In addition, in JP-A-6-138851, an example in which the number of input terminals of the demultiplexer is configured to be half the number of the data lines is described.

However, when switching elements constituting the demultiplexer are formed by using transistors, large transistors are required so as to decrease ON resistance of the transistors. In particular, when the switching elements are formed by amorphous silicon type thin film transistors having a low mobility, very large transistors are required. Since an area for forming the demultiplexer is an outer frame of a display area, so-called a frame size becomes large, and accordingly, there is a limitation on exterior design of the electronic device into which a display panel is inserted.

SUMMARY

An advantage of some aspects of the invention is that it provides an electro-optical device, a driving circuit, and an electronic apparatus which can decrease the frame size thereof in a case where the data lines are driven by using a demultiplexer.

According to a first aspect of the invention, there is provided a driving circuit of an electro-optical device that has a plurality of scan lines, a plurality of data lines divided into groups each having m (where m is an integer equal to or greater than two) data lines, and pixels, which are provided in correspondence with intersections of the plurality of scan lines and the plurality of data lines, having gray scale levels in accordance with voltage values of the plurality of data lines at a time when the plurality of scan lines are individually selected and drives the plurality of data lines when one of the plurality of scan lines is selected. The driving circuit includes: first transistors, which are provided in the plurality of data lines, each having one end commonly connected together in each group and the other terminal connected to the data line; second transistors, which are provided in the plurality of data lines, each having one end connected to the data line and the other end commonly connected together in each group; a control circuit that sequentially selects m data lines belonging to each group in a predetermined order at a time when the one of the plurality of scan lines is selected and makes one and the other terminals of the first transistor and the second transistor corresponding to the selected data line be in a mutual conduction state, respectively; a data signal output circuit that outputs data signals having voltage values in accordance with gray scale levels of pixels corresponding to intersections of the one scan line and the selected data line in each group; and operational amplifiers, which are provided in correspondence with the each group, each setting a high voltage value to a voltage supplied to the one terminal of the first transistor in a case where the voltage of the one terminal of the second transistor in the conduction state is lower than a voltage of the data signal output from the data signal output circuit and setting a low voltage value to a voltage supplied to the one terminal of the first transistor in a case where the voltage of the one terminal of the second transistor in the conduction state is lower than the voltage of the data signal output from the data signal output circuit. According to the driving circuit, the operational amplifier circuit controls the voltage value supplied to one terminal of the first transistor such that the voltage of one terminal of the second transistor is identical to the voltage of the data signal output form the data signal output circuit. Accordingly, it is possible to correctly supply a data signal having a voltage value in accordance with the gray scale level, even when the ON resistance between the one and other terminals of the first transistor is high.

The driving circuit may be configured such that the data signals output from the data signal output circuit are supplied to non-inverting input terminals of the operational amplifier circuits, the commonly connected portions of the other terminals of the second transistors are connected to the inverting input terminals of the operational amplifier circuits, and output terminals of the operational amplifier circuits are connected to the commonly connected portions of the one terminals of the first transistors. In such a case, resistors may be interposed between the output terminals of the operational amplifier circuits and the inverting input terminals.

The driving circuit may be configured such that the data signals output from the data signal output circuit are supplied to the non-inverting input terminals of the operational amplifier circuits, the output terminals of the operational amplifier circuits are connected to the commonly connected portions of the one terminals of the first transistors, a resistor and a first switch are provided for each operational amplifier circuit, the resistors are interposed between the output terminals of the operational amplifier circuits and the inverting input terminals of the operational amplifier circuits, and the first switches, between the commonly connected portions of the other terminals of the second transistors and the inverting input terminals of the operational amplifier circuits, are turned off during a former period in a period during which one data line in each group is selected and are turned on during a latter period in the period during which one data line in each group is selected. In such a case, the operational amplifier circuit serves as a voltage buffer circuit in the former period and performs a negative feedback for matching the voltage of the data line to the voltage of the data signal in the latter period.

In addition, The driving circuit may be configured such that second switches are provided for the operational amplifier circuits and the second switches, between the output terminals of the operational amplifier circuits and the commonly connected portions of the other terminals of the second transistors, are turned on during the former period and are turned off during the latter period. In such a case, in the former period, the operational amplifier circuit serves as a voltage buffer circuit and the output terminal of the operational amplifier circuit is connected to the data line through parallel paths of the first and second transistors, and accordingly, the resistance between the output terminal of the operational amplifier circuit and the data line decreases. In addition, in the latter period, the operational amplifier circuit performs the above-described negative feedback control.

The driving circuit may be configured such that auxiliary switches are additionally include for the operational amplifier circuits and the auxiliary switches are turned on during the former period and turned off during the latter period, between the output terminals of the operational amplifier circuits and the inverting input terminals.

In addition, the present invention can be implemented as an electro-optical device or an electronic apparatus having the electro-optical device along with the scan line driving circuit of an electro-optical device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the present invention will be described with reference to the accompanying drawings.

First Embodiment

Figure 1:
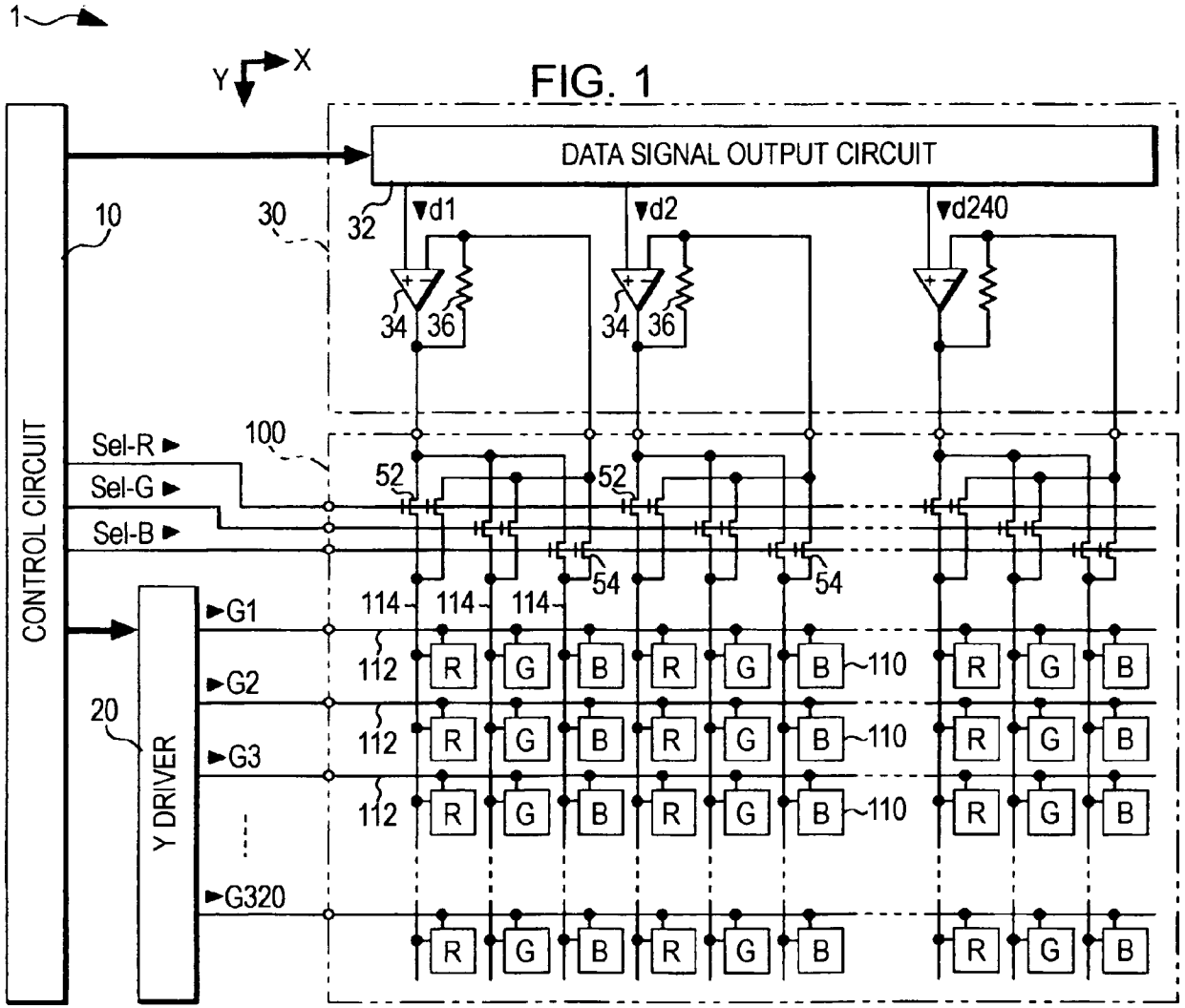
FIG. 1 is a diagram showing the configuration of an electro-optical device according to a first embodiment of the present invention.

FIG. 1 is a diagram showing the configuration of an electro-optical device according to a first embodiment of the invention.

As shown in the figure, the electro-optical device 1 is basically divided into a control circuit 10, a Y driver 20, an X driver 30, and a display panel 100.

Among these components, the display panel 100, not shown in the figure, has a configuration in which an element substrate and an opposing substrate are disposed together with a constant gap maintained therebetween such that electrode forming surfaces thereof face each other and a liquid crystal is sealed inside the gap. On the element substrate, the Y driver 20 and the X driver 30, which are semiconductor chips, are mounted by using COG (chip on glass) technology or the like. To the Y driver 20, the X driver 30, and the display panel 100, various control signals transmitted from the control circuit 10 are supplied through an FPC (flexible printed circuit) substrate or the like.

The display panel 100 is divided into an area having a demultiplexer or the like formed thereon and an area for display. According to this embodiment, in the area for display, 320 scan lines 112 are disposed to extend in a row direction (direction X), and 720 (=240×3) data lines 114 divided into groups of three lines are disposed to extend in a column direction (direction Y) while maintaining electrical insulation from the scan lines 112.

Sub-pixels (pixels) 110 are disposed so as to be in correspondence with intersections of the 320 scan lines 112 and the 720 data lines 114. Among these sub-pixels 110, three sub-pixels 110 corresponding to an intersection of a scan line 112 and three data lines 114 belonging to a same group corresponds to R (red), G (green), and B (blue) colors. One dot is represented by these three sub-pixels 110. Thus, in this embodiment, the sub-pixels 110 are arranged in the shape of a matrix of vertical 320 rows and horizontal 720 columns. Accordingly, the dots display colors in vertical 320 rows× horizontal 240 columns.

When an integer j that is equal to or greater than "1" and equal to or less than "240" is used for a generalized description of a row (group) of the dots, the (3j−2)-th, (3j−1)-th, and (3j)-th data lines 114 from the left side of FIG. 1 belong to the j-th block and form colors of R, G, and B.

Figure 2:
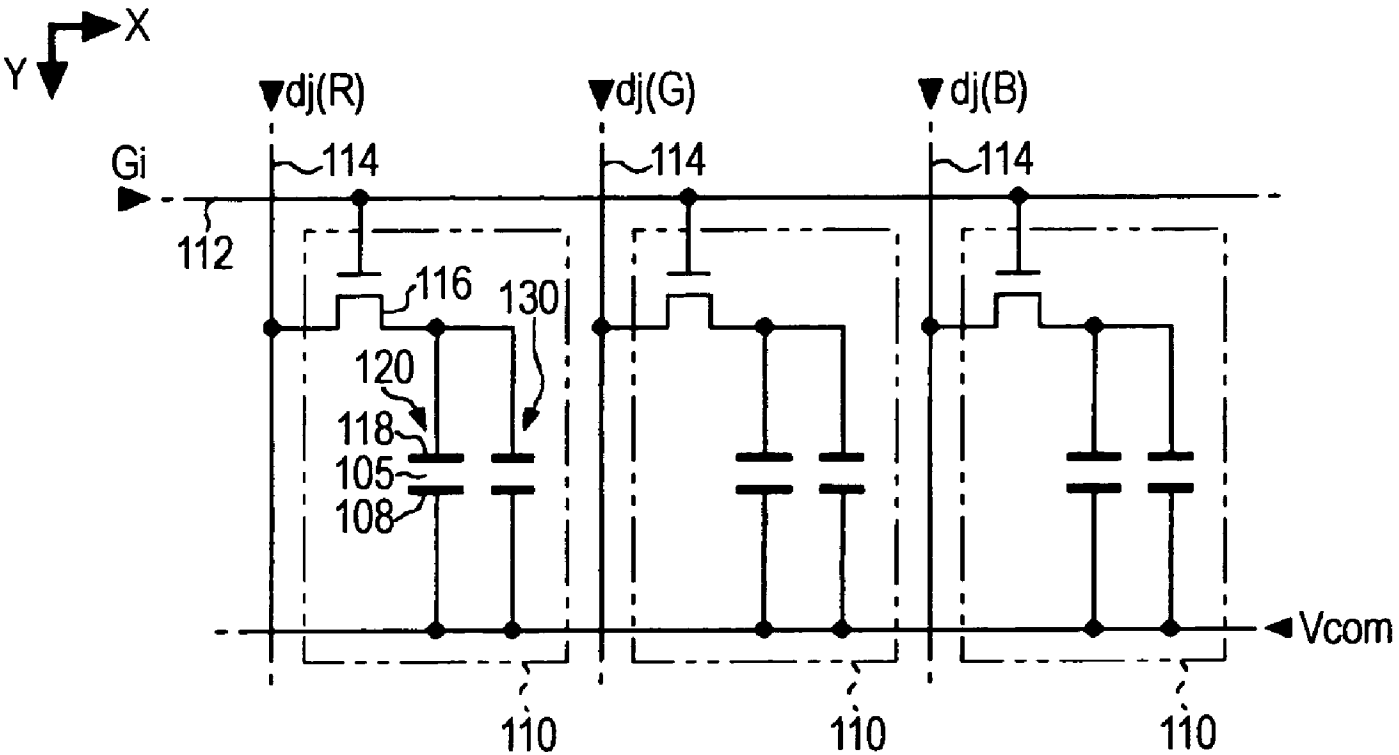
FIG. 2 is a diagram showing the configuration of the sub-pixel of the electro-optical device.

The configuration of the sub-pixels 110 will now be described with reference to FIG. 2. FIG. 2 is a diagram showing the electrical configuration of the sub-pixels 110. In the figure, the configuration of three sub-pixels 110 corresponding to intersections of the i-th scan line 112 and three data lines 114 corresponding to the j-group is shown. Here, "i" is a generalized symbol for representing a row (row of a scan line 112) in which the sub-pixel 110 is arranged and is an integer equal to or greater than "1" and equal to or less than "320".

As shown in FIG. 2, three sub-pixels 110 have the same electrical configurations with each other. Each sub-pixel 110 has an n-channel thin film transistor (hereinafter, abbreviated as TFT) 116 that is a pixel switching element, a liquid crystal capacitor 120, and a storage capacitor 130.

Among these components, a gate electrode of the TFT 116 is connected to the i-th scan line 112, a source electrode of the TFT 116 is connected to the data line 114, and a drain electrode of the TFT 116 is connected a pixel electrode 118 that is one terminal of the liquid crystal capacitor 120.

The other terminal of the liquid crystal capacitor 120 is connected to a common electrode 108. The common electrode 108 is formed on the opposing substrate and faces the pixel electrode 118 through the liquid crystal. In this embodiment, a constant voltage value Vcom is applied to the common electrodes 108 of all the sub-pixels 110 of the display panel 100. Thus, the liquid crystal capacitor 120 has a configuration in which the liquid crystal 105 is pinched by the pixel electrode 118 and the common electrode 108.

In addition, in each sub-pixel 110, one color filter of a corresponding color, that is, R, G, or B color is provided. The transmittance of the liquid crystal capacitor 120 changes depending on an RMS value of a voltage value maintained thereby. For example, in this embodiment, the liquid crystal capacitance 120 is configured to be in a normally-white mode in which as the RMS value of the voltage thereof decreases, the amount of transmitted light increases.

In the sub-pixel 110 having such a configuration, when the i-th scan line 112 has a voltage value Vdd (selection voltage value) that is equal to or greater than a threshold value, the source and drain electrodes of the TFT 116 become in a conduction (ON) state. Under the ON state, for example, when a voltage higher (positive polarity) or lower (negative polarity) than the voltage value Vcom applied to the common electrode 108 by a voltage value in accordance with a gray scale (brightness) level of the sub-pixel in the (3j−2)-th column of the i-th row is supplied to the (3j−2)-th data line 114, the supplied voltage is applied to the pixel electrode 118 of the sub-pixel through the TFT 116, and accordingly, a difference voltage between the voltage applied to the pixel electrode 118 and the voltage applied to the common electrode 108 is charged in the liquid crystal 120.

When the i-th scan line 112 has zero volt (non-selection voltage value) below the threshold value, the source and drain electrodes of the TFT 116 become in a non-conduction (OFF) state. However, the voltage that has been charged in the liquid crystal capacitor 120 at a time when the TFT 116 is in On state is maintained without any change.

Accordingly, in the liquid crystal capacitor 120, an RMS value of the voltage of the difference between the voltage applied to the pixel electrode 118 at a time when the TFT 116 is in ON state and the voltage Vcom applied to the common electrode 108 is maintained, and thus, the liquid crystal capacitor 120 has transmittance (brightness) in accordance with the RMS value of the difference voltage.

When the TFT 116 is in OFF status, the OFF resistance does not become infinity, unlike an ideal case, and thus, charges accumulated in the liquid crystal capacitance 120 leak in a considerable amount. In order to decrease the off-leak, the storage capacitor 130 to be described is formed for each sub-pixel. While one terminal of the storage capacitor 130 is connected to the pixel electrode 118 (the drain electrode of the TFT 116), the other terminal thereof is commonly connected to capacitor lines of all the sub-pixels. In this embodiment, since the capacitor lines are maintained at the same voltage value LCcom as the common electrode 108, as shown in FIG. 2, the liquid crystal capacitor 120 and the storage capacitor 130 have a configuration equivalent to that in which the capacitors are connected in parallel between the drain electrode of the TFT 116 and a feeder wire having the voltage value Vcom.

The voltage of the capacitor lines may have a voltage value other than the voltage value LCcom applied to the common electrode. Furthermore, the voltage applied to the common electrode and the voltage of the capacitor line may not be maintained at a constant voltage and be configured to be shifted between a high voltage value and a low voltage value.

When a DC component is applied to the crystal 105, the crystal is deteriorated, and thus, the voltage (the voltage of a data signal) to be applied to the pixel electrode 118 is alternately shifted between a high potential and a low potential with respect to the voltage value Vcom of the common electrode 108. Thus, a case where the voltage polarity (writing polarity) of the pixel electrode 118 has a potential higher than the voltage value Vcom is referred to as a positive polarity, and a case where the voltage polarity of the pixel electrode 118 has a potential lower than the voltage value Vcom is referred to as a negative polarity. As described above, the writing polarity is measured with reference to the voltage value Vcom. However, the voltage value, unless mentioned otherwise, is measured with reference to the ground potential Gnd corresponding to logic level L which is zero volts.

As the type of shift of the writing polarities of the sub-pixels, which are arranged in a matrix shape, for one frame, there are various types in which the polarities of the sub-pixels are shifted for each scan line (row inversion), for each data line (column inversion), for each sub-pixel (dot inversion), or the like, and all the types can be used. However, in this embodiment, for the convenience of description, it is assumed that the polarity inversion is performed for each frame.

Referring back to FIG. 1, the Y driver 20 is a scan line driving circuit that sequentially selects $1^{st}$, $2^{nd}$, 3rd, $4^{th}$, . . . , and $320^{th}$ scan lines 112 for each horizontal scan period H in accordance with control of the control circuit 10 in the mentioned order and supplies a voltage value Vdd corresponding to level H to the selected scan line 112 and zero volt (grounded electrical potential Gnd) corresponding to level L to the other scan lines 112 as a scan signal.

For the convenience of description, scan signals supplied to the $1^{st}$, $2^{nd}$, $3^{rd}$, $4^{th}$, . . . , and $320^{th}$ scan lines 112 are denoted as G1, G2, G3, G4, . . . , and G320, and in a general description not for a particular scan line, the scan signal is denoted as Gi by using the above-described "i".

The control circuit 10 exclusively sets one of selection signals Sel-R, Sel-G, and Sel-B for indicating selection of the data lines 114 of color R, G, or B in each group to level H in the mentioned order for each period S resulting from dividing the horizontal scan period H, during which one scan line 112 is selected, by three.

The X driver 30 includes a data signal output circuit 32 and pairs of an operational amplifier 34 (operational amplifier circuit) that is provided in correspondence with each block and a resistor 36.

Among these components, the data signal output circuit 32 outputs data signals having the following voltage values under the control of the control circuit 10. The data signal output circuit 32 outputs data signals having voltage values in accordance with gray scale levels of the sub-pixels 110 corresponding to intersections of scan lines 112 selected by the Y driver 20 and data lines designated by the selection signal Sel-R, Sel-G, or Sel-B from among three data lines 114 in each block.

Here, for the convenience of description, data signals output in correspondence with the $1^{st}$ to $240^{th}$ blocks are denoted as d1 to d240. On the other hand, in a general description not for a particular block, a data signal output in correspondence with a block is denoted as dj by using the above-described "j".

The operational amplifier 34 provided in correspondence with each block outputs a voltage from its output terminal, so that the voltage values of a non-inverting input terminal (+) and an inverting input terminal (−) are identical to each other. For example, the operational amplifier 34 corresponding to the j-th block has the following configuration of connection.

To the non-inverting input terminal (+) of the j-th operational amplifier 34, a data signal dj is supplied, and the inverting terminal (−) thereof is connected to a common drain electrode of the TFT 54 in the j-th block, to be described later.

In addition, the output terminal thereof is connected to a common source electrode of the TFT 52 in the j-th block, and a resistor 36 is interposed between the output terminal and the inverting terminal (−).

In each 720 data lines 114, a pair of TFTs 52 and 54 is provided. Between the TFTs, the TFT 52 (first transistor) distributes a signal (output signal) output from the output terminal of the operational amplifier 34 to three data lines 114 corresponding to a corresponding block and constitutes a demultiplexer.

In particular, the source electrodes of three TFTs 52 corresponding to the j-th block are commonly connected to an output terminal of the operational amplifier 34 in the block, and each drain electrode thereof is connected to one end of the data lines 114 thereof. In addition, the gate electrode of the TFT 52 of color R in each block is connected to a signal line for supplying a selection signal Sel-R, and the gate electrodes of the TFT 52 of G and color B in each block are connected to signal lines for supplying selection signals Sel-G and Sel-B.

On the other hand, the TFT 54 (second transistor) connects a selected data line 114 in the block to the inverting input terminal (−) of the operational amplifier 34. In particular, each source electrode of three TFTs 54 corresponding to the j-th block is connected to one end of the data lines 114, and the drain electrodes thereof are commonly connected to a junction that is connected to the inverting input terminal (−) of the operational amplifier 34 corresponding to the j-th block.

When the X driver 30 is built in the display panel 100 by using COG technology, a junction thereof is a portion denoted as ○ shown in FIG. 1.

Figure 3:
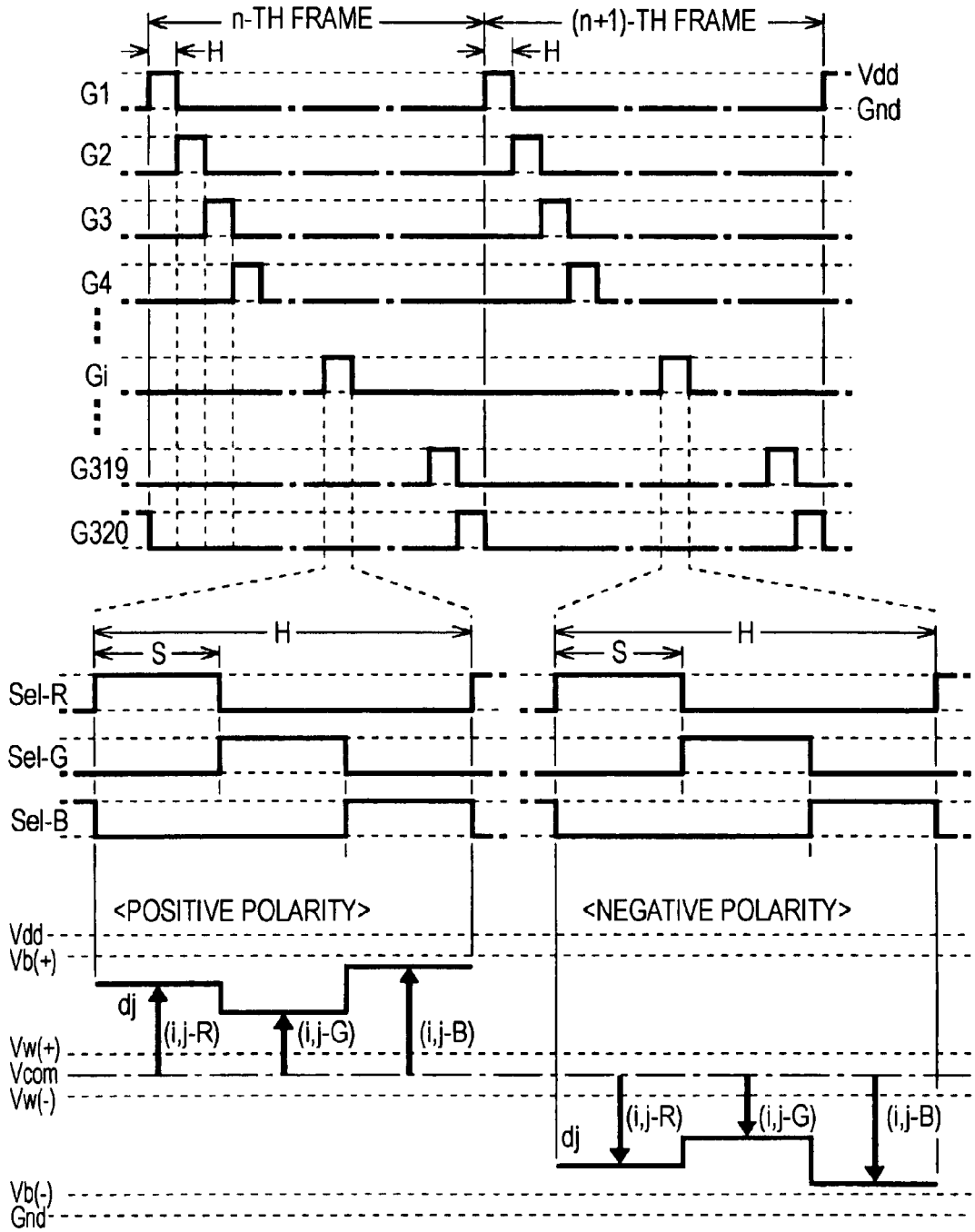
FIG. 3 is a timing chart showing an operation of the electro-optical device.

Next, the operation of the electro-optical device 1 will be described. FIG. 3 is a timing chart for describing the operation.

First, the scan signals G1 to G320 exclusively become level H one by one during a period of a frame in each horizontal scan period H. Here, the period of one frame is about 16.7 milliseconds (the reciprocal of 60 Hz) and is a period required for writing voltage values in accordance with gray scale levels in all the sub-pixels 110 in the $1^{st}$ to $320^{th}$ rows.

Among the scan signals G1 to G320, a horizontal period H during which the scan signal Gi supplied to the i-th scan line becomes level H will now be described for a generalized description without specifying a particular row. As shown in the figure, the control circuit 10 sets the selection signals Sel-R, Sel-G, and Sel-B to level H exclusively for each period S in the mentioned order during the horizontal scan period H.

When the selection signal Sel-R becomes level H in a period during which the scan signal Gi supplied to the i-th scan line is level H, the data signal output circuit 32 sets the data signal dj corresponding to the j-th block to a voltage value which is in accordance with a gray scale level of a sub-pixel 110 corresponding to the intersection of the i-th scan line 112 and the data line 114 of color R in the j-th block and is a voltage value having one between the positive polarity and the negative polarity. Here, the voltage having the positive polarity is used.

When the selection signal Sel-R becomes level H, the source and drain electrodes of all the TFTs 52 and 54 corresponding to data lines 114 of color R in each block become in a mutual conduction state.

Accordingly, when the j-th block is considered, the output terminal of the operational amplifier 34 in the block is connected to the data line 114 of color R in the j-th block through the TFT 52 that is in ON state, and the data line 114 of color R is connected to the inverting input terminal (−) of the operational amplifier 34 through the TFT 54 that is in ON state.

Thus, since the voltage applied to the data line 114 of color R is feedback to the inverting input terminal of the operational amplifier 34, the operational amplifier 34 in the j-th block controls the voltage applied to the data line 114 of color R to be identical to the voltage of the data signal dj supplied to the non-inverting input terminal (+).

In particular, the TFT 54 in the conduction state serves as a resistor. Thus, for example, the j-th operational amplifier 34, together with the TFT 54 serving as a resistor and the resistor 36, increases a voltage value of the output terminal thereof when the voltage of the data line 114 of color R detected through the TFT 54 is lower than that of the data signal dj supplied to the non-inverting input terminal (+). On the other hand, when the voltage of the data line 114 of color R is higher than that of the data signal dj, the j-th operational amplifier 34 decreases the voltage value of the output terminal thereof. Accordingly, the voltage applied to the data line 114 of color R is balanced in a point at which the voltage applied to the data line 114 of color R is identical to the voltage of the data signal dj.

When the scan signal Gi become level H, all the TFTs 116 of which gate electrodes are connected to the i-th scan line 112 are turned on. Thus, the output signal of the operational amplifier 34 in the j-th block is applied to the pixel electrode 118 of the sub-pixel 110 of color R corresponding to the intersection of i-th scan line 112 and the data line 114 of color R in the j-th block, through the j-th data line 114 of color R and the turned-on TFT 116. Accordingly, a voltage value corresponding to a difference between the voltage values Vcom of the common electrode 108 and the data signal dj, that is, a voltage value in accordance with the gray scale level of the sub-pixel of color R is written in the liquid crystal 120 of the sub-pixel of color R.

Next, when the selection signals Sel-G and Sel-B sequentially become level H in the mentioned order, the X driver 30 sets the data signal dj to voltage values having the positive polarity in accordance with gray scale levels of sub-pixels 110 of colors G and B corresponding to the intersections between the i-th scan line 112 and data lines 114 of colors G and B in the j-th block. Accordingly, the voltages controlled to be identical to the data signal dj are sequentially supplied to the data lines 114 of colors G and B in the j-th block, and voltage values in accordance with the gray scale levels of the sub-pixels G and B are written in the liquid crystal capacitors 120 of the sub-pixels of colors G and B.

Thus, in three sub-pixels corresponding to the intersections between the i-th scan line 112 and the data lines 114 of colors R, G, and B constituting the j-th block, voltage values in accordance with the gray scale levels are sequentially written.

Here, although the writing operation for three sub-pixels corresponding to the j-th block has been described, in period during which the scan signal Gi becomes level H, similar writing operations are performed parallel at the same time for the sub-pixels 110 corresponding to the $1^{st}$, $2^{nd}$, $3^{rd}$, . . . , and $240^{th}$ blocks of the i-th row.

In addition, although, only the writing operation for pixels of one row located in the i-th scan line 112 has been described, the scan signals G1 to G320 sequentially become level H in the period of one frame, and accordingly, the writing operation for the pixels of one row is performed in the order of the $1^{st}$, $2^{nd}$, $3^{rd}$, . . . , and $320^{th}$ rows.

In addition, for the following frames, although the same writing operation is performed in the order of the $1^{st}$, $2^{nd}$, $3^{rd}$, . . . , and $320^{th}$ rows, at this moment, the writing polarity of the liquid crystal is inverted for each frame. In other words, when the positive polarity is used in a frame, then the negative polarity is used in the next frame. Thus, since the writing polarities of the voltage values maintained in the liquid crystal capacitor 120 is inverted (driven alternately) for each frame, deterioration of the liquid crystal 105 due to application of a DC component can be prevented.

In FIG. 3, in the horizontal scan period H during which the scan signal Gi becomes level H, a change in the voltage value of the data signal dj output in correspondence with the j-th block is shown.

The voltage of the data signal dj in the horizontal scan period H has a difference voltage between the voltage in accordance with the gray scale level of the sub-pixel and the voltage value Vcom of the common electrode 108. In the negative polarity writing, the data signal dj in the horizontal scan period H can have a voltage in the range of a voltage value Vb(+) corresponding to a most dark state in the normally-white mode to a voltage value Vw(+) corresponding to the brightest state. On the other hand, in the positive polarity writing, the data signal dj in the horizontal scan period H can have a voltage in the range of a voltage value Vb(−) corresponding to a most dark state to a voltage value Vw(−) corresponding to the brightest state.

The voltages corresponding to the difference between the gray scale levels and the voltage value Vcom are indicated as "↑" for the positive polarity and "↓" for the negative polarity, in FIG. 3. Here, "(i, j-R) denotes a sub-pixel corresponding to an intersection of the i-th scan line and the data line of color R in the j-th block. Similarly, (i, j-G) and (i, j-B) denote sub-pixels corresponding to intersections of the i-th scan line and the data lines of colors G and B in the j-th block.

The positive polarity voltage Vw(+) and the negative polarity voltage Vw(−) are symmetrical with respect to the voltage value Vcom. In addition, the positive polarity voltage Vb(+) and the negative polarity voltage Vb(−) are symmetrical with respect to the voltage value Vcom.

The vertical scale of the voltage value of the data signal dj in FIG. 3 is relatively enlarged, compared to the vertical scale of voltage waveforms of logic signals (level H is the source voltage Vdd, and level L is the electric potential Gnd). The same vertical scales as those in FIG. 3 are used in FIG. 5, to be described later.

As described above, according to this embodiment, the voltage of the data line 114 is negatively feedback controlled by the operational amplifier 34 through the TFT 54 so as to be identical to the voltage value of the data signal dj output from the data signal output circuit 32 even in a case where the ON resistance of the TFT 52 constituting the demultiplexer is high, and accordingly, it is not needed to increase the size of the transistor of the TFT 52.

In this embodiment, the TFT 54 is required additionally. However, the function of the TFT 54 is for performing a negative feedback of the voltage of the data line 114 to the inverting input terminal (−) of the operational amplifier 34, and the resistance (ON resistance) between the source and drain electrodes in ON state is configured to be lower than the resistance of the resistor 36 and is not needed to be close to zero. In other words, when ON resistance of the TFT 54 is Rs, the resistance of the resistor 36 is Rf, and the voltage difference between the voltage values of the data line 114 and the data signal dj (set to be V0) is V1, then the output voltage of the operational amplifier 34 becomes V0−(Rf/Rs)×V1. When Rf/Rs>1, a compensation voltage is superposed. Accordingly, in this embodiment, a large area is not required for forming the TFTs 52 and 54, and thus, the frame size is not required to be large.

When the resistor 36 is not provided in this embodiment, the following problems may occur. When the resistor 36 is not included, if the TFTs 52 and 54 are turned off due to any reason (for example, timing discrepancy or the like) at a time when a data signal is output from the data signal output circuit 32, the voltage of the data line 114 is not feedback, and thus an open gain voltage value, which is deviated from the voltage value of the data signal, is output from the output terminal of the operational amplifier. Accordingly, in this embodiment, when the data signal is output from the data signal output circuit 32 and the TFTs 52 and 54 are turned off, the resistor 36 is interposed between the output terminal of the operational amplifier 34 and the inverting input terminal (−) so as to enable the operational amplifier 34 to serve as a voltage buffer circuit for amplifying the voltage of the data signal supplied to the non-inverting input terminal (+) by an amplification factor of "+1".

Second Embodiment

In the above-described first embodiment, the operational amplifier 34 is configured to perform the above-described negative feedback in the whole the period S during which the data signal output circuit 32 outputs a data signal having a voltage value in accordance with the gray scale level.

The data lines 114 have various parasitic capacitances and thus have a characteristic for maintaining the voltage level thereof. Thus, right before the voltage in accordance with the gray scale level is supplied to the data line 114 in the horizontal scan period H during which the i-th scan line is selected, a voltage value in accordance with a display content of the (i−1)-th row, which is one row before the current row, is maintained in the data line 114. Accordingly, there is a case where a change in the voltage of the data line 114 becomes large when the voltage in accordance with the gray scale level is applied in the horizontal scan period H during which the i-th row is selected. In such a case, when the operational amplifier 34 performs negative feedback control, a defective operation such as an increase in current consumption of the operational amplifier 34 or an occurrence of oscillation may be easily caused.

Thus, a second embodiment in which the above-described defective operation is suppressed will now be described.

Figure 4:
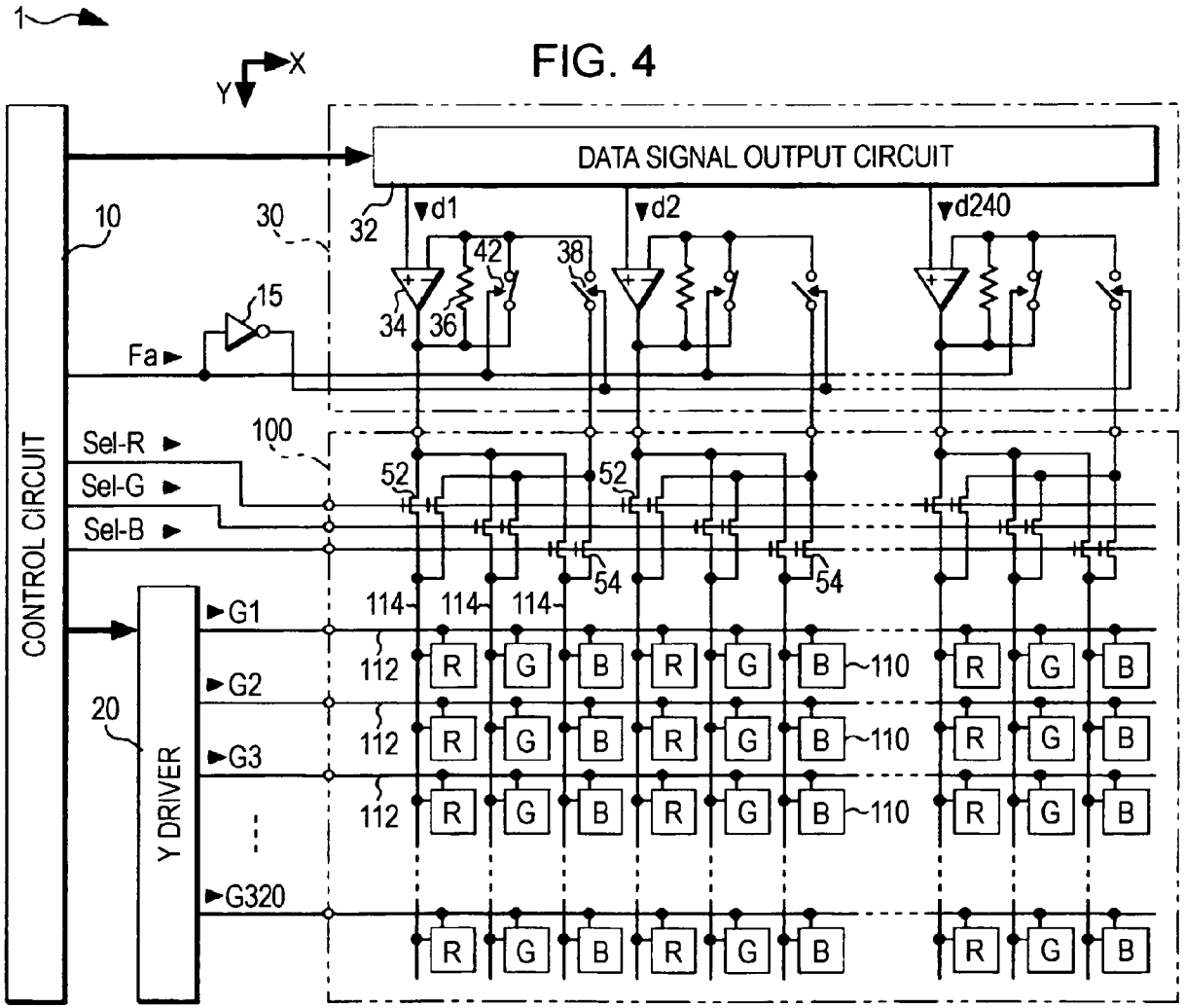
FIG. 4 is a diagram showing the configuration of an electro-optical device according to a second embodiment of the invention.

FIG. 4 is a block diagram showing the configuration of an electro-optical device according to the second embodiment of the invention.

As shown in the figure, differences between the first and second embodiments are that, first, the control circuit 10 outputs a signal Fa and, second, there are switches 38 and 42 for each operational amplifier 34, in the second embodiment.

Figure 5:
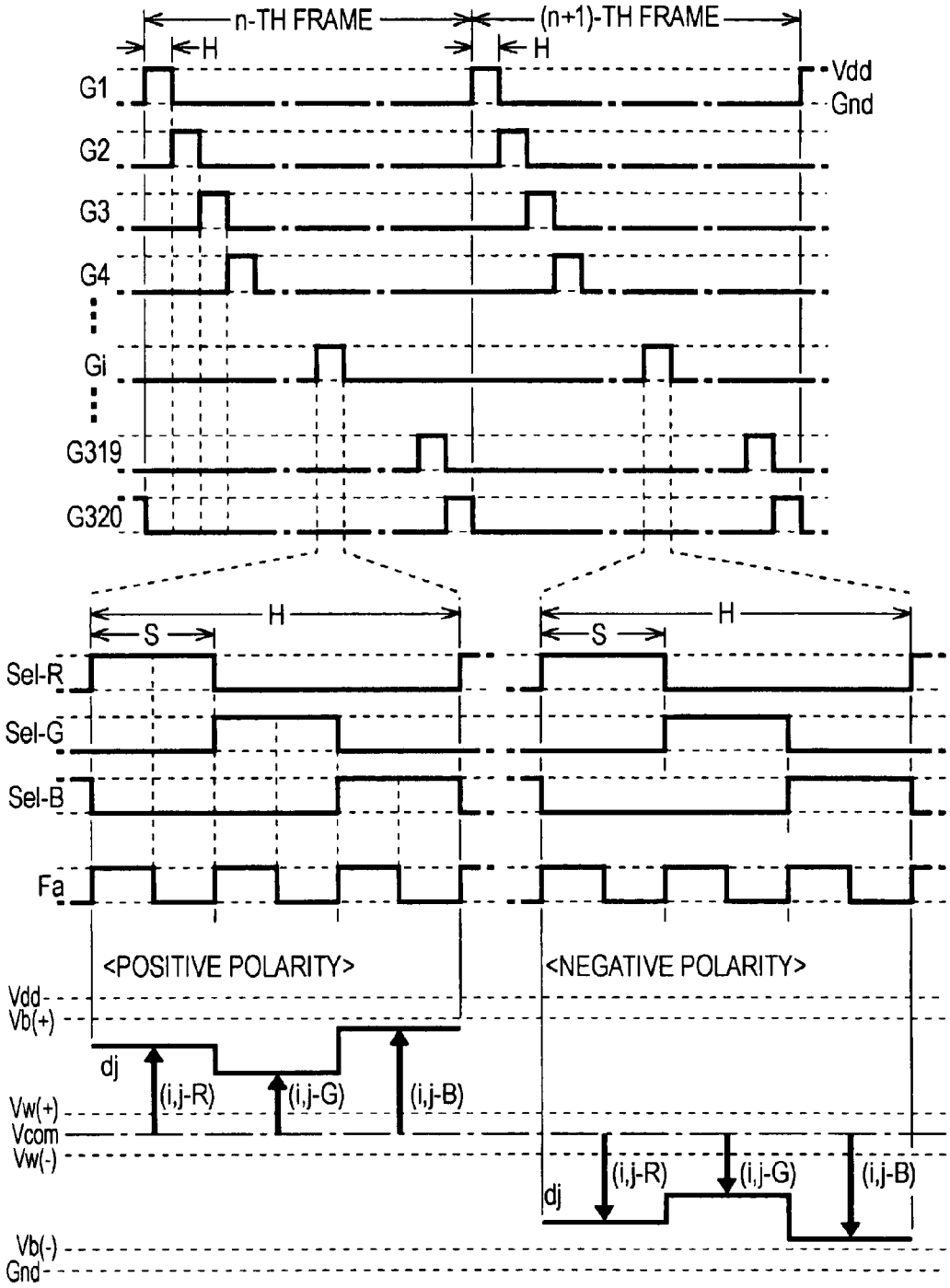
FIG. 5 is a timing chart showing an operation of the electro-optical device.

The second embodiment will now be described with primarily focused on the differences. First, the control circuit 10, as shown in FIG. 5, outputs a signal Fa that is level H in the first half period of the period S resulting from dividing the horizontal scan period H by three and is level L in the second half period thereof.

Next, the switch 38 (primary switch) is turned on when a signal resulting from logically inverting the signal Fa by the logical NOT circuit 15 is level H (the signal Fa is level L). On the other hand, the switch 38 is turned off when a signal resulting from logically inverting the signal Fa by the logical NOT circuit 15 is level L (the signal Fa is level H). The switch 38 is interposed between the common drain electrode of the TFT 54 and the inverting input terminal (−) of the operational amplifier 34. In addition, the switch 42 (secondary switch) is turned on when the signal Fa is level H, and the switch 42 is turned off when the signal Fa is level L. The switch 34 is interposed between the output terminal of the operational amplifier 34 and the inverting input terminal (−) of the operational amplifier 34.

Figure 6A:
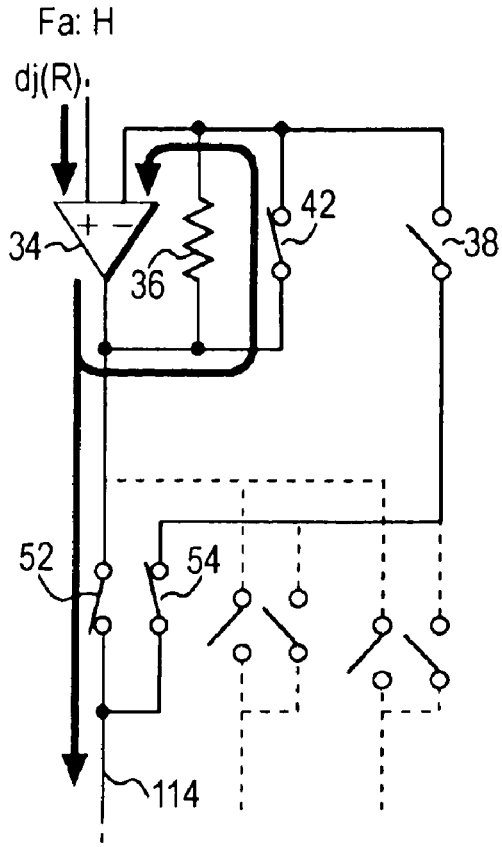
FIG. 6 is a diagram showing an operation of the electro-optical device.

Here, for example, when the selection signal Sel-R becomes level H, and thus the signal Fa becomes level H, as shown in FIG. 6A, the TFTs 52 and 54 corresponding to the data line 114 of color R are turned on, the switch 38 is turned off, and the switch 42 is turned on, and accordingly, the inverting input terminal (−) of the operational amplifier 34 is connected to not the data line 114 but the output terminal of the operational amplifier 34. Thus, the operational amplifier 34 serves as a voltage buffer having a simple function for buffering the voltage of the data signal output from the data signal output circuit 32.

Accordingly, the voltage of the data line 114 becomes the output voltage of the operational amplifier 34 serving as the voltage buffer circuit, and thereby the voltage of the data line 114 becomes close to the voltage of the data signal.

Figure 6B:
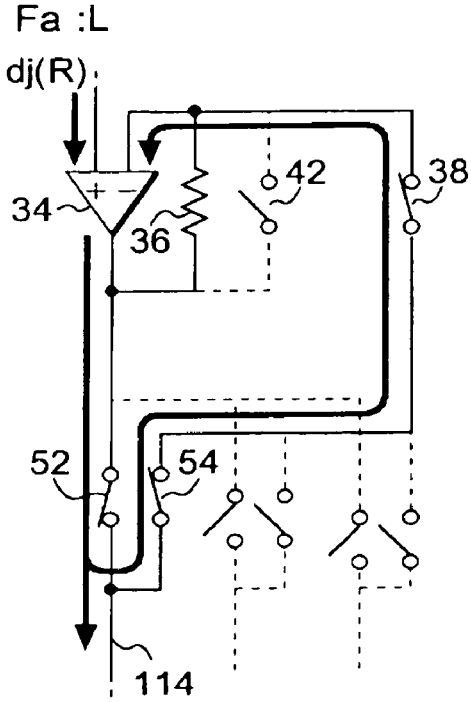

Next, in a state that the selection signal Sel-R is level H, when the signal Fa changes to level L, as shown in FIG. 6B, the switch 38 is turned on and the switch 42 is turned off while the TFTs 52 and 54 corresponding to the data line 114 of color R maintain to be ON state, and accordingly, the inverting input terminal (−) of the operational amplifier 34 is connected to the data line 114 of color R through the TFT 54 that is in ON state. Thus, as in the first embodiment, the data line 114 is controlled to be negatively feedback such that the voltage value of the data line 114 is identical to the voltage value of the data signal output from the data signal output circuit 32.

As described above, in the second embodiment, the voltage value of the data line 114 become close to the voltage value of the data signal owing to the operational amplifier 34 serving as a voltage buffer circuit, prior to the negative feedback control, and then, the voltage of the data line is controlled to be negatively feedback such that the voltage value of the data line is identical to the voltage value of the data signal output from the data signal output circuit 32 owing to the turned-on TFT54. Accordingly, it is possible to suppress a defective operation such as an increase in current consumption of the operational amplifier 34 or an occurrence of oscillation, even when the change in the voltage of the data line 114 is large due to shift of selection.

Third Embodiment

Figure 7:
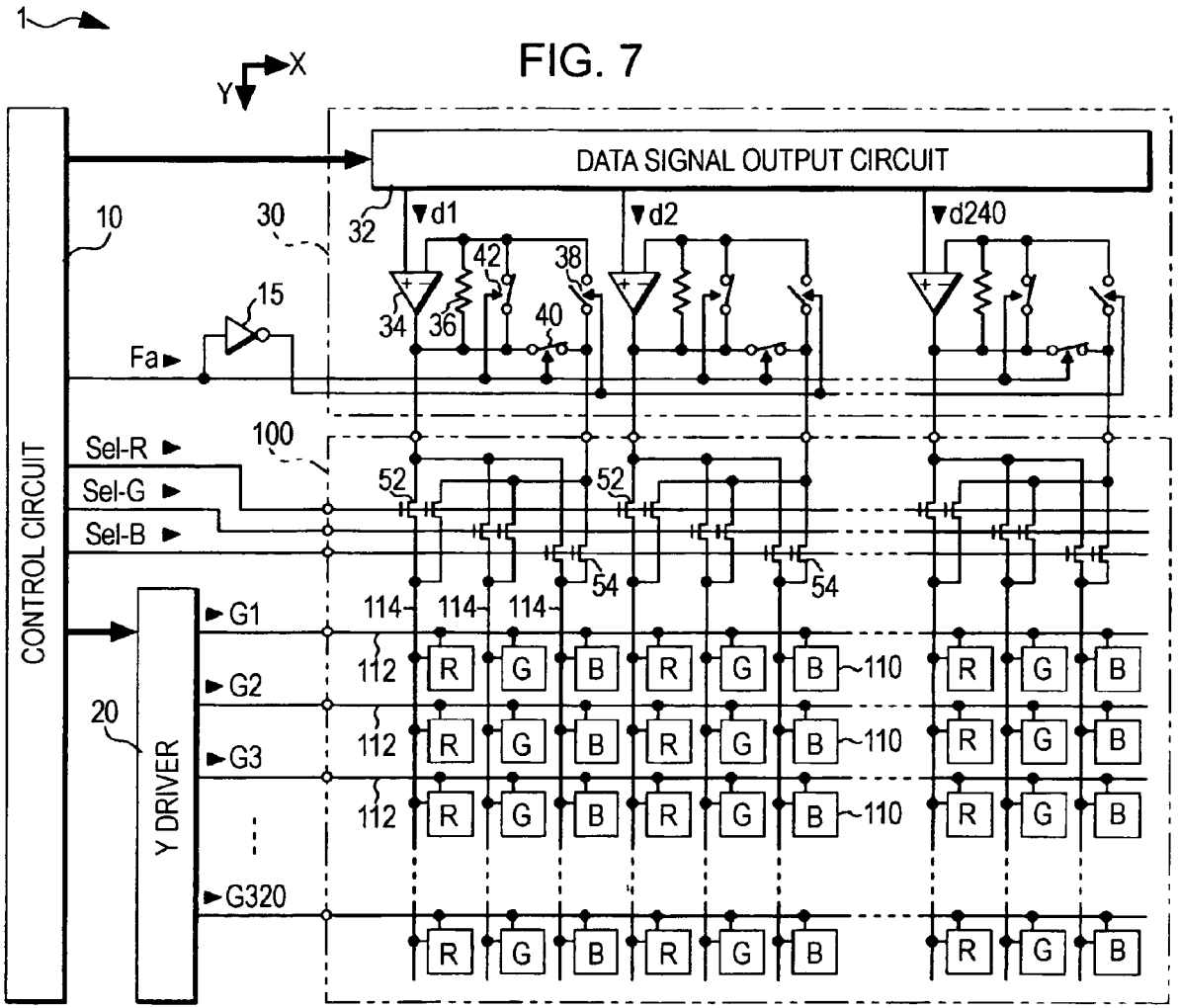
FIG. 7 is a diagram showing the configuration of an electro-optical device according to a third embodiment of the invention.

Next, an electro-optical device according to a third embodiment of the invention will be described with reference to FIG. 7.

As shown in the figure, the difference between the second embodiment (see FIG. 4) and the third embodiment is that a switch 40 is disposed for each operational amplifier 34 in the third embodiment.

The third embodiment will now be described with primarily focused on the difference. The switch 40 (second switch) is turned on when the signal Fa is level H, and the switch 40 is turned off when the signal Fa is level L. The switch 40 is interposed between the output terminal of the operational amplifier 34 and the common drain electrode of the TFT 54.

Figure 8A:
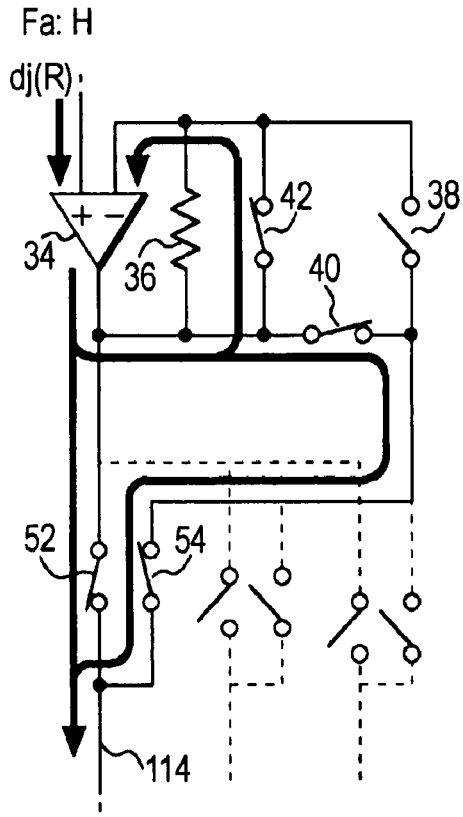
FIG. 8 is a diagram showing an operation of the electro-optical device.

Here, for example, when the selection signal Sel-R becomes level H and the signal Fa is level H, as shown in FIG. 8A, the TFTs 52 and 54 corresponding to the data line 114 of color R are turned on, and the switch 38 is turned off and the switch 42 is turned on as in the second embodiment, and accordingly, the operational amplifier 34 serves as a simple voltage buffer circuit. In addition, the switch 40 is turned on, and thus, between the output terminal of the operational amplifier 34 and the data line 114, a route through the TFT 54 is connected in parallel with a route through the turned-on TFT 52.

Thus, the resistance between the output terminal of the operational amplifier 34 and the data line 114 is lowered, compared to a case where there is only the route through the TFT 52. Accordingly, the data line 114 becomes close to or reaches the voltage value of the data signal output from the data signal output circuit in a shorter period owing to the operational amplifier 34 serving as a voltage buffer circuit.

Figure 8B:
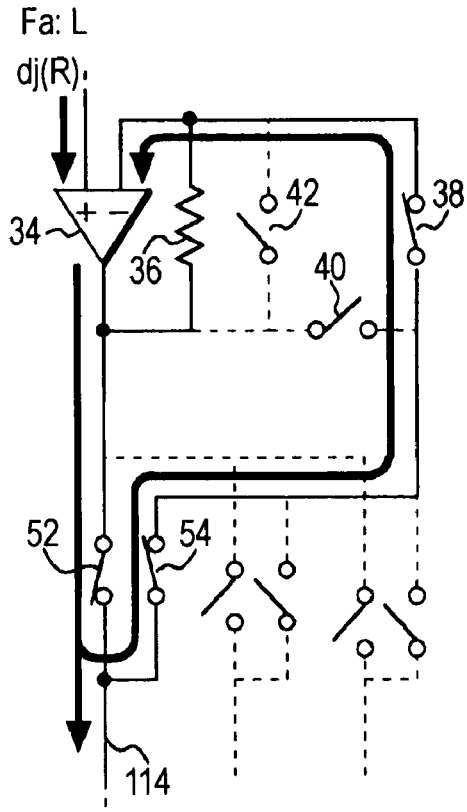

In addition, in a state that the selection signal Sel-R is level H, when the signal Fa changes to level L, as shown in FIG. 8B, the switch 38 is turned on and the switches 40 and 42 are turned off while the TFTs 52 and 54 corresponding to the data line 114 of color R maintain to be ON state, and accordingly, the connection state becomes the same as shown in FIG. 6B. In other words, the data line 114 is controlled to be negatively feedback such that the voltage value of the data line 114 is identical to the voltage value of the data signal output from the data signal output circuit 32 by turning on the TFT 54.

Although the source and drain electrodes of the TFTs 52 and 54 have been differentiated for denoting the input and output sides, for the TFT 54 in the third embodiment, the input and output sides of a signal is changed in a period during which the operational amplifier serves as the voltage buffer circuit and in a period for negative feedback control during which the voltage of the data line 114 is made identical to the output voltage of the data signal output circuit. In addition, since the TFTs 52 and 54 only serve as switches in any of the above-described embodiments, and accordingly, it is possible to consider the terminals of each TFT 52 or 54 as one terminal and the other terminal without being identified as the source and drain electrodes thereof.

In the above-described second and third embodiments, when the operational amplifier 34 serves as a voltage buffer circuit, the output terminal of the operational amplifier 34 and the inverting input terminal (−) are short-circuited with the switch 42, but when the resistance of the resistor 36 is low, the switch 42 may be omitted.

However, when the resistance Rf of the resistor 36 becomes lower than the resistance Rs of the turned-on TFT 54, the relationship of Rf/Rs>1 is not satisfied. Thus, when the switch 42 is omitted, it should be considered that the resistance Rf of the resistor 36 is set to be low for enabling the operational amplifier to serve as a voltage buffer circuit and is set to be higher than the resistance Rs of the turned-on TFT 54.

In other words, when a configuration including the switch 42 is used, the above-described consideration is not needed.

In the second and third embodiments, although the period during which the operational amplifier 34 serves as a voltage buffer circuit and the period for negative feedback control during which the voltage of the data line 114 is made to be identical to the output voltage of the data signal output circuit are configured to be continuous, both the periods may be configured to be not continuous.

In the above-described embodiments, although the control circuit 10 is configured to output the selection signals Sel-R, Sel-G, and Sel-B for the convenience of description, the selection signals are directly related with the operation of the data signal output circuit 32, and thus, a circuit for output of the selection signals may be built in the data signal out circuit 32 or may be provided in the X driver 30 additionally.

In the above-described embodiments, although the number m of the data lines constituting one group has been described as three, the number of the data lines may be two or more.

When the X driver 30 is built in the display panel 100 using the COG technology, although the number of junctions increases to 480, which is twice as many as the number of the groups, compared to a case where general technology is used, the increase in the number of the junctions can be prevented by increasing the number of the data lines constituting one group. For example, when the total number of data lines is "720", if the number of data lines constituting one group is set to six, the number of junctions can decrease to "240".

In the above-described embodiments, although the writing polarity has been described to be inverted for each period of one frame, the purpose is for driving the liquid crystal capacitor 120 alternately, and accordingly, the inverting cycle may be a period of two frames or more.

In addition, although a normally-white mode is used for the liquid crystal capacitors 120 in the above-described embodiments, however, a normally-black mode in which a dark state is activated without application of voltage may be used. A different color (for example, cyan (C)) may be used in addition to the R (red), G (green), and B (blue), and one dot may be configured by using sub-pixels of the four colors for improving color reproducibility. A color filter may not be provided, and simple monochrome display may be used.

In addition, although a case where the selection signals Sel-R, Sel-G, and Sel-B exclusively have level H at a time has been shown, for example, when the polarity is inverted for each scan line, all the selection signals Sel-R, Sel-G, and Sel-B may be set to level H first, and then the selection signals Sel-R, Sel-G, and Sel-B may be set to level H exclusively at a time. In such a case, first, all the data lines can be set to voltage values having a polarity for sub-pixel writing. Especially, in the second and third embodiments, when all the data lines have voltage values having a polarity for sub-pixel writing in the period during which the operational amplifiers 34 are used as voltage buffer circuits, a buffer period is commonly used for the colors R, G, and B, and accordingly, a period used for controlling a negative period can be extended. Accordingly, voltage writing with high precision can be performed without using high-speed operational amplifiers.

In the above descriptions, although the reference of the writing polarity is configured to be the voltage value Vcom applied to the common electrode 108, however, this configuration is for a case where the TFTs 116 serve as ideal switches. In practical use, a phenomenon (referred to as push-down, penetration, field-through, or the like), in which the electric potential of the drain electrode (pixel electrode 118) is lowered due to parasitic capacitance between the gate and drain electrodes of the TFT 116 at a time when the TFT 116 is turned off from a turned-on status, occurs. In order to prevent deterioration of the liquid crystal, the liquid crystal capacitor 120 should be driven by an alternating current. However, when the voltage value Vcom applied to the common electrode 108 is set as a reference for writing polarity and the crystal capacitor is driven by an alternating current, the RMS value of the voltage of the liquid crystal capacitor 120 for a negative polarity writing becomes slightly greater than that for positive polarity writing (in a case where the TFT 116 is an n-channel type) due to the pushdown. Accordingly, the reference voltage of writing polarity and the voltage value LCcom of the common electrode 108 may be differentiated, and, in particular, the reference voltage of writing polarity may be set to be higher than the voltage LCcom by an offset so as to offset the effect of the push down.

Electronic Apparatus

Figure 9:
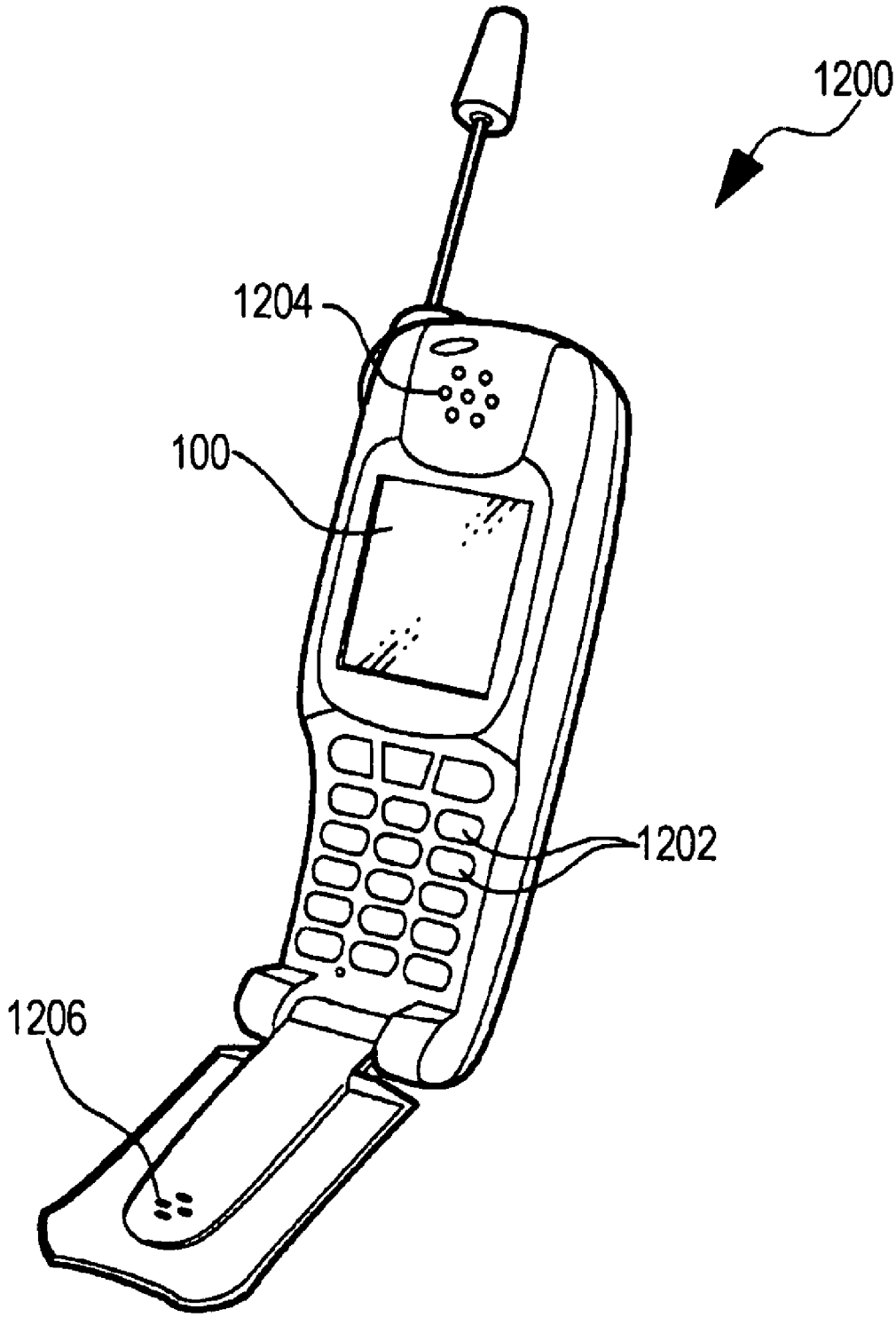
FIG. 9 is a diagram showing the configuration of a cellular phone using an electro-optical device according to an embodiment of the invention.

Next, an electronic apparatus in which the electro-optical device 1 according to the above-described embodiment is used will be described. FIG. 9 is a diagram showing the configuration of a cellular phone 1200 using the electro-optical device 1 according to this embodiment.

As shown in this figure, the cellular phone 1200 includes the above-described electro-optical device 1 in addition to a plurality of operation buttons 1202, an ear piece 1204, and a mouthpiece 1206. The constitutional elements of the electro-optical device 1 other than a portion corresponding to the display area 100 do not appear externally.

As examples of electronic apparatuses, in which the electro-optical device 1 can be used, other than the cellular phone shown in FIG. 9, there are a digital camera, a photo storage, a notebook computer, a liquid crystal television set, a view finder-type (or direct view-type) video cassette recorder, a car navigator, a pager, an electronic diary, an electronic calculator, a word processor, a workstation, an video telephone, a POS terminal, and a device having a touch panel. It is needless to say that an electro-optical device 1 according to an embodiment of the invention may be applied to the above-described various electronic devices.

The entire disclosure of Japanese Patent Application No. 2007-064503, filed Mar. 14, 2007 is expressly incorporated by reference herein.

What is claimed is:

1. A driving circuit of an electro-optical device that has a plurality of scan lines, a plurality of data lines divided into groups each having m (where m is an integer equal to or greater than two) data lines, and pixels, which are provided in correspondence with intersections of the plurality of scan lines and the plurality of data lines, having gray scale levels in accordance with voltage values of the plurality of data lines at a time when the plurality of scan lines are individually selected and drives the plurality of data lines when one of the plurality of scan lines is selected, the driving circuit comprising:

first transistors, which are provided in the plurality of data lines, each having one end commonly connected together in each group and the other terminal connected to the data line;

second transistors, which are provided in the plurality of data lines, each having one end connected to the data line and the other end commonly connected together in each group;

a control circuit that sequentially selects m data lines belonging to each group in a predetermined order at a time when the one of the plurality of scan lines is selected and makes one and the other terminals of the first transistor and the second transistor corresponding to the selected data line be in a mutual conduction state, respectively;

a data signal output circuit that outputs data signals having voltage values in accordance with gray scale levels of pixels corresponding to intersections of the one scan line and the selected data line in each group to each group; and operational amplifiers, which are provided in correspondence with the each group, each setting a high voltage value to a voltage supplied to the one terminal of the first transistor in a case where the voltage of the one terminal of the second transistor in the conduction state is lower than a voltage of the data signal output from the data signal output circuit and setting a low voltage value to a voltage supplied to the one terminal of the first transistor in a case where the voltage of the one terminal of the second transistor in the conduction state is lower than the voltage of the data signal output from the data signal output circuit, wherein the data signals output from the data signal output circuit are supplied to the non-inverting input terminals of the operational amplifier circuits, the output terminals of the operational amplifier circuits are connected to the commonly connected portions of the one terminals of the first transistors, a resistor and a first switch are provided for each operational amplifier circuit, the resistors are interposed between the output terminals of the operational amplifier circuits and the inverting input terminals of the operational amplifier circuits, and the first switches, between the commonly connected portions of the other terminals of the second transistors and the inverting input terminals of the operational amplifier circuits, are turned off during a former period in a period during which one data line in each group is selected and are turned on during a latter period in the period during which one data line in each group is selected.

2. The driving circuit according to claim 1, wherein the data signals output from the data signal output circuit are supplied to non-inverting input terminals of the operational amplifier circuits, wherein the commonly connected portions of the other terminals of the second transistors are connected to the inverting input terminals of the operational amplifier circuits, and wherein output terminals of the operational amplifier circuits are connected to the commonly connected portions of the one terminals of the first transistors.

3. The driving circuit according to claim 2, wherein resistors are interposed between the output terminals of the operational amplifier circuits and the inverting input terminals.

4. The driving circuit according to claim 1, wherein second switches are provided for the operational amplifier circuits, and wherein the second switches, between the output terminals of the operational amplifier circuits and the commonly connected portions of the other terminals of the second transistors, are turned on during the former period and are turned off during the latter period.

5. The driving circuit according to claim 1, wherein auxiliary switches are additionally included for the operational amplifier circuits, and wherein the auxiliary switches are turned on during the former period and turned off during the latter period, between the output terminals of the operational amplifier circuits and the inverting input terminals.

6. The driving circuit according to claim 1, wherein the first switch is turned off and on during the period when one data line in each group is selected and the first transistor and the second transistor are turned on and the data signal is supplied to one data line in each group.

7. An electro-optical device comprising:

a plurality of scan lines;

a plurality of data lines divided into groups each having m (where m is an integer equal to or greater than two) data lines;

pixels, which are provided in correspondence with intersections of the plurality of scan lines and the plurality of data lines, having gray scale levels in accordance with voltage values of the plurality of data lines at a time when the plurality of scan lines are individually selected;

a scan line driving circuit that sequentially selects the plurality of scan lines in a predetermined order; and a data line driving circuit that drives the plurality of data lines when one of the plurality of scan lines is selected, wherein the data line driving circuit includes:

first transistors, which are provided in the plurality of data lines, each having one end commonly connected together in each group and the other terminal connected to the data line;

second transistors, which are provided in the plurality of data lines, each having one end connected to the data line and the other end commonly connected together in each group;

a control circuit that sequentially selects m data lines belonging to each group in a predetermined order at a time when the one of the plurality of scan lines is selected and makes one and the other terminals of the first transistor and the second transistor corresponding to the selected data line be in a mutual conduction state, respectively;

a data signal output circuit that outputs data signals having voltage values in accordance with gray scale levels of pixels corresponding to intersections of the one scan line and the selected data line in each group; and operational amplifiers, which are provided in correspondence with the each group, each setting a high voltage value to a voltage supplied to the one terminal of the first transistor in a case where the voltage of the one terminal of the second transistor in the conduction state is lower than a voltage of the data signal output from the data signal output circuit and setting a low voltage value to a voltage supplied to the one terminal of the first transistor in a case where the voltage of the one terminal of the second transistor in the conduction state is lower than the voltage of the data signal output from the data signal output circuit, wherein the data signals output from the data signal output circuit are supplied to the non-inverting input terminals of the operational amplifier circuits, the output terminals of the operational amplifier circuits are connected to the commonly connected portions of the one terminals of the first transistors, a resistor and a first switch are provided for each operational amplifier circuit, the resistors are interposed between the output terminals of the operational amplifier circuits and the inverting input terminals of the operational amplifier circuits, and the first switches, between the commonly connected portions of the other terminals of the second transistors and the inverting input terminals of the operational amplifier circuits, are turned off during a former period in a period during which one data line in each group is selected and are turned on during a latter period in the period during which one data line in each group is selected.

8. An electronic apparatus having the electro-optical device according to claim 7.

9. The electro-optical device according to claim 7, wherein the first switch is turned off and on during the period when one data line in each group is selected and the first transistor and the second transistor are turned on and the data signal is supplied to one data line in each group.

* * * * *